US008247720B2

(12) United States Patent
Peng

(10) Patent No.: US 8,247,720 B2
(45) Date of Patent: Aug. 21, 2012

(54) SEALED PUSHBUTTON SWITCH

(75) Inventor: Xin-Yun Peng, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 236 days.

(21) Appl. No.: 12/786,450

(22) Filed: May 25, 2010

(65) Prior Publication Data

US 2010/0294636 A1 Nov. 25, 2010

(51) Int. Cl.
*H01H 13/06* (2006.01)

(52) U.S. Cl. ..... 200/302.2; 200/531

(58) Field of Classification Search ..... 200/302.2, 200/536, 520, 530–532, 302.1, 329, 61.62, 200/61.71, 61.73, 61.74
See application file for complete search history.

(56) References Cited

U.S. PATENT DOCUMENTS 4,616,112 A * 10/1986 Galloway et al. ..... 200/531
6,459,057 B1 * 10/2002 Domzalski ..... 200/302.2
6,953,903 B2 * 10/2005 Berger et al. ..... 200/61.62
6,998,556 B1 * 2/2006 Ho ..... 200/531
7,329,821 B2 2/2008 Tan
7,547,856 B2 6/2009 Tan

* cited by examiner

*Primary Examiner* — Briggitte R Hammond
(74) *Attorney, Agent, or Firm* — Wei Te Chung; Andrew C. Cheng; Ming Chieh Chang

(57) ABSTRACT

A sealed pushbutton switch includes an insulative housing defining a cavity, an actuator moveably retained in the insulative housing, a base conglutinated to the insulative housing by glue, a number of fixed contacts assembled to the base, a spring mounted below the actuator, and a moveable contact mounted on the actuator and provided with a number of contact portions in contact with corresponding fixed contacts. The moveable contact is moveable with the actuator from a first position to a second position relative to the insulative housing along a top-to-bottom direction to disengage the fixed contacts. The base defines a first slot formed along an edge of a inner face of said base and a second slot formed on a position of the inner face except the edge, the second slot have a connection with the first slot so as to retain glue therein when said base and said housing are fastened together by said glue.

17 Claims, 5 Drawing Sheets

SEALED PUSHBUTTON SWITCH

BACKGROUND OF THE INVENTION

1. Field of the Invention

The present invention relates to a sealed pushbutton switch, and particularly to a normally closed sealed pushbutton switch used in various electronic appliance.

2. Description of Related Art

A conventional sealed pushbutton switch is described in U.S. Pat. No. 7,329,821, which was issued on Feb. 12, 2008. The sealed pushbutton switch is normally in a closed position, comprising an insulative housing defining a cavity, an actuator moveably retained in the cavity of the insulative housing, a base conglutinated to the insulative housing by glue, a number of fixed contacts assembled to the base, a spring mounted below the actuator, and a moveable contact mounted on the actuator and provided with a number of contact portions in contact with corresponding fixed contacts. The moveable contact is moveable with the actuator from a first position to a second position relative to the insulative housing along a top-to-bottom direction to disengage the fixed contacts. The base has an inner face defining four slots defined near four sides thereof.

The base is conglutinated to the insulative housing by glue or epoxy, which would creep into the inulative housing through some gaps defined between the base and the insulative housing. The base defines the slots to retain glue therein when said base and said housing are fastened together by said glue. But according to prior art, the pushbutton switch have a defect in assemble, said slots of the base don't have enough space to receive the glue.

Hence, an improved pushbutton switch is required to overcome the above-mentioned disadvantages of the related art.

SUMMARY OF THE INVENTION

A primary object of the present invention is to provide a sealed pushbutton switch being ensured of a reliable operation.

To achieve the aforementioned objects, a sealed pushbutton switch includes an insulative housing defining a cavity, an actuator moveably retained in the insulative housing, a base conglutinated to the insulative housing by glue, a number of fixed contacts assembled to the base, a spring mounted below the actuator, and a moveable contact mounted on the actuator and provided with a number of contact portions in contact with corresponding fixed contacts. The moveable contact is moveable with the actuator from a first position to a second position relative to the insulative housing along a top-to-bottom direction to disengage the fixed contacts. The base defines a first slot formed along an edge of a inner face of said base and a second slot formed on a position of the inner face except the edge. The second slot has a connection with the first slot so as to retain glue therein when said base and said housing are fastened together by said glue.

The glue being about to filter into the cavity of the insulative housing is retained in the first slot which formed along an edge of a inner face of said base. The second slot further affords enough space to support the first slot receiving the glue. Unreliable operation resulted from creeping glue could be avoided.

Other objects, advantages and novel features of the invention will become more apparent from the following detailed description of a preferred embodiment when taken in conjunction with the accompanying drawings.

DETAILED DESCRIPTION OF THE INVENTION

Figure 1:
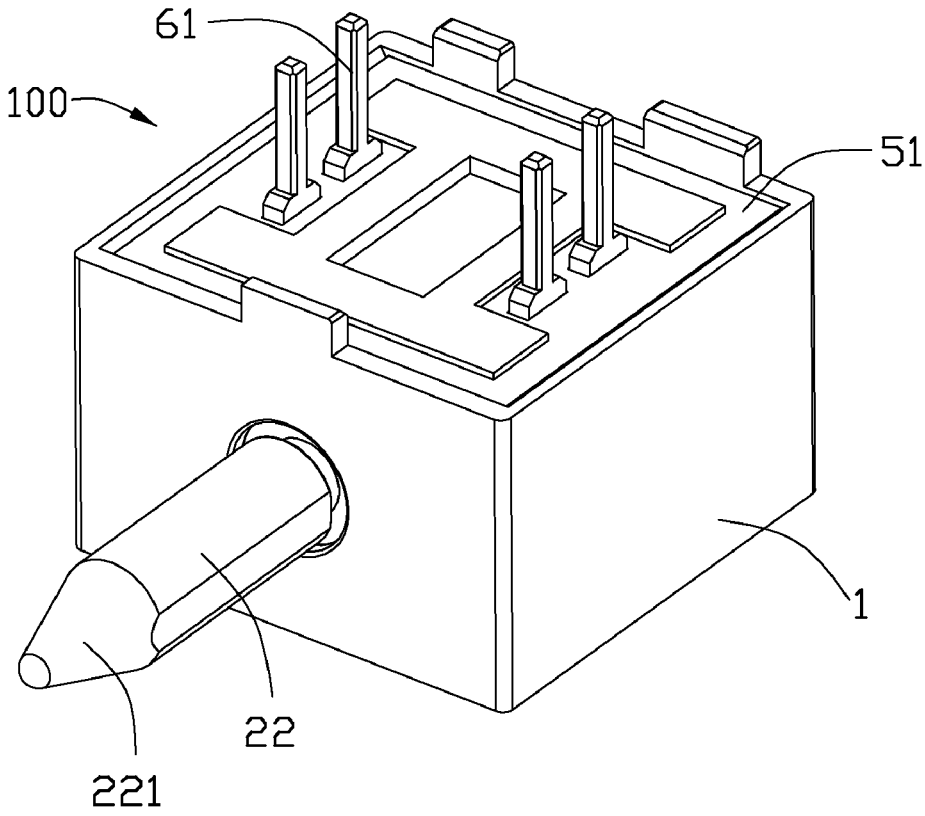
FIG. 1 is an assembled perspective view of a sealed pushbutton switch in accordance with the present invention.

Reference will now be made to the drawing figures to describe the present invention in detail. Referring to FIGS. 1-5, a sealed pushbutton switch 100 in accordance with the preferred embodiment of the present invention comprises an insulative housing 1 defining a cavity 15, an actuator 2 retained in the cavity 15 of the insulative housing 1, a moveable contact 3, a coil compression spring 4 bearing against the actuator 2, a base 5 attached to the insulative housing 1, and a pair of fixed contacts 6 mounted on the base 5.

Figure 2:
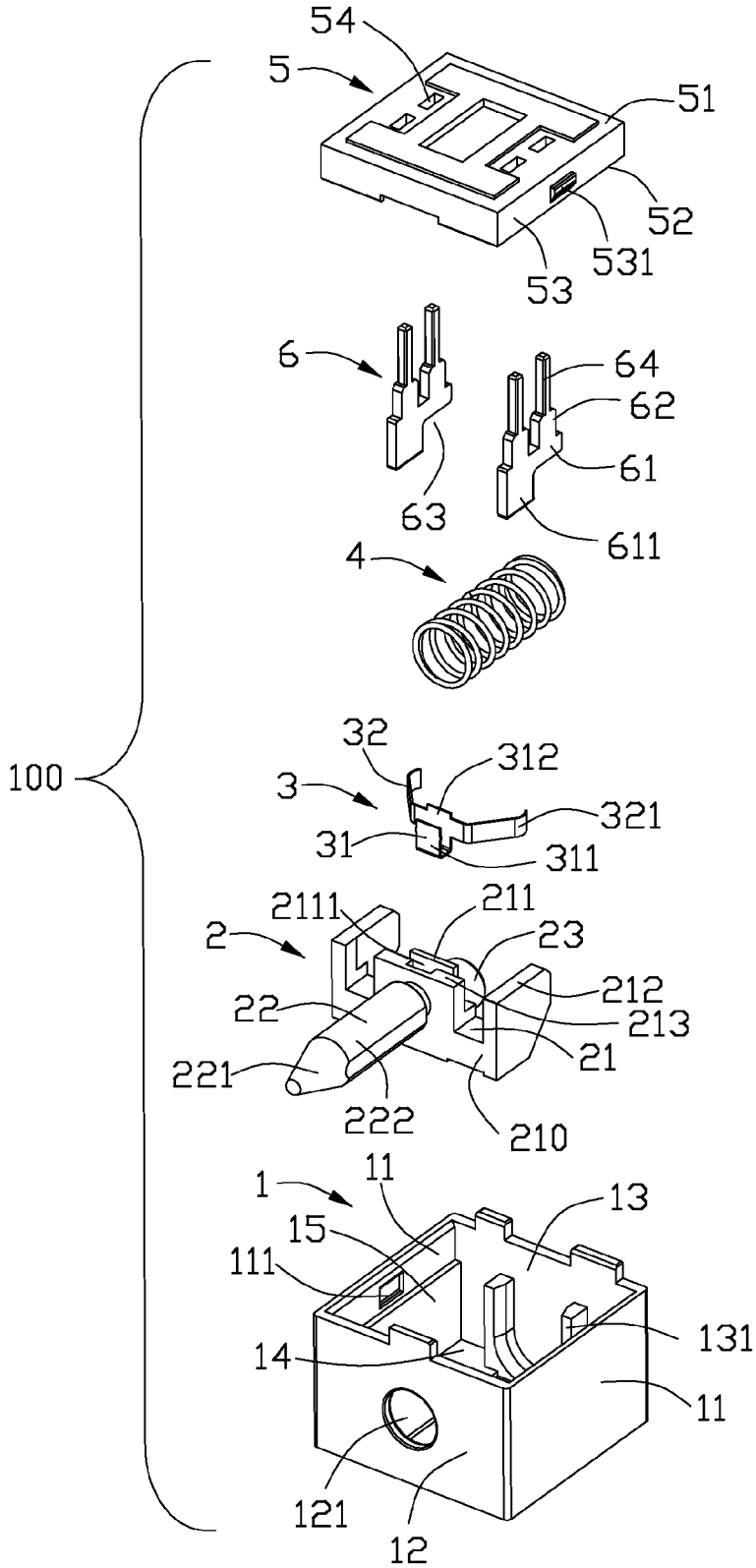
FIG. 2 is a exploded perspective view of the sealed pushbutton switch as shown in FIG. 1.

Referring to FIG. 2, the insulative housing 1 is a substantially rectangular case, comprising a front wall 12, a back wall 13 opposite to the front wall 12, a bottom wall 14 connecting the front wall 12 and the back wall 13, a pair of side walls 11 extending upwardly from the bottom wall 14 to thereby define the cavity 15 therebetween. The front wall 12 has a circular through hole 121 defined in a central portion thereof. Each side wall 11 has a recess 111 defined in an inner surface thereof. A C-shape protrusion 131 is formed on the back wall 13, and extends upwardly to the front wall 12.

Referring to FIG. 2, the actuator 2 comprises a body portion 21 and a button 22 extending frontwardly from a surface of the body portion 21. The button 22 includes a columnar portion 222, and a guiding portion 221 having a conical shape for facilitating insertion into the through hole 121 during assembly. The body portion 21 is provided with a rectangular primary wall 210, a pair of periphery walls 212 perpendicular to opposite sides of the primary wall 210, and a columnar post 23 extending backwardly from the primary wall 210 for engaging the spring 4. A nose portion 213 configured as a flat plane projects upwardly from a center of an upper portion of the primary wall 210, and is flush with a top surface of the primary wall 210 for upholding the button 22. A slot 2111 is defined at a bottom of the nose portion 213 in a longtitudinal direction. A tongue portion 211 is defined horizontally below the nose portion 213.

Figure 3:
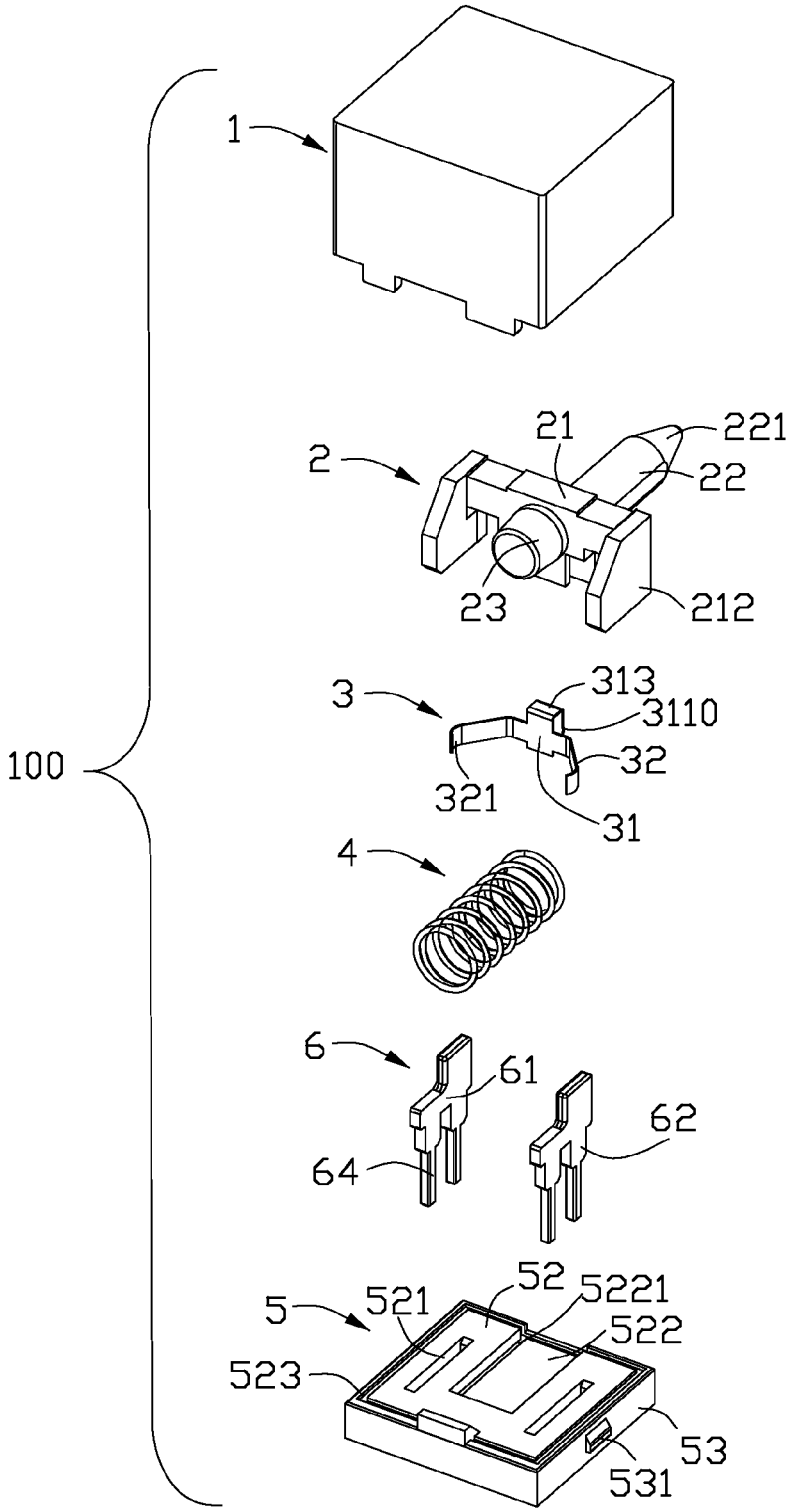
FIG. 3 is a exploded perspective view of the sealed pushbutton switch.

Referring to FIGS. 2-3, the moveable contact 3 is formed by bending a punched metal plate, comprising a retention portion 31 and a pair of elastic beams 32. The retention portion 31 has a primary plate 312, an insertion plate 311 extending parellel to the primary plate 312 and positioned a certain distance above the primary plate 312. The insertion plate 311 has a pair of click projections 3110 formed at opposite edges thereof. A connection plate 313 extends in another direction perpendicular to the extending direction of the primary plate 312 for connecting the insertion plate 311 and primary plate 312 together. The pair of elastic beams 32 extend symmetrically horizontally firstly from a center of opposite sides of the primary plate 312 and then outspread obliquely downwardly. A contact portion 321 having a semicircular curved surface is formed on a free end of each elastic beam 32.

Referring to FIGS. 2-3, each fixed contact 6 comprises a body portion 61, a pair of soldering portions 64, and a pair of connection portions 62 connecting the corresponding soldering portions 64 to the body portion 61. The body portion 61 is configured as a lying "L", with one end thereof protruding laterally therefrom to form an engaging portion 611. The body portion 61 has an indentation 63 defined beside the engaging portion 611.

Figure 5:
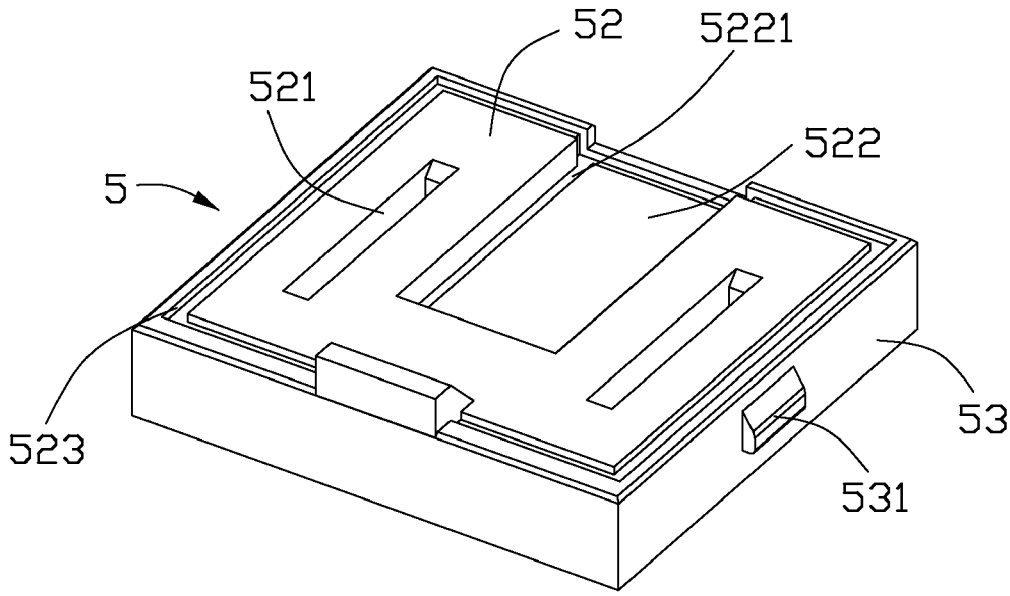
FIG. 5 is a perspective view of a base as shown in FIG. 3.

Referring to FIGS. 2-3, in conjunction with FIG. 5, the base 5 is substantially flat, comprising an inner face 51, an outer face 52 opposite to the inner face 51, four side faces 53 and a pair of tubers 531 formed at two opposite side faces 53 thereof. The inner face 51 defines a groove 522 on a middle position thereof for engaging with the nose portion 213 of the actuator 2. A first slot 523 is formed along an edge of the inner face 51, and a second slot 5221 is formed along an edge of the groove 522 of said base 5, the first slot 523 have a connection with the second slot 5221 so as to retain glue therein when said base 5 and said housing 1 are fastened together by said glue. The inner face 51 further has a pair of retaining channels 521 symmetrically defined therein. The outer face 52 defines therein two pairs of insertion channels 54 respectively communicating with corresponding retaining channel 521 for extension of the soldering portions 64 of the fixed contacts 6.

Referring to FIGS. 1-5, in assembly of the sealed pushbutton switch 100, the moveable contact 3 is fastened to the body portion 21 of the actuator 2 firstly. The retention portion 31 of the moveable contact 3 is confined between the nose portion 213 and the tongue portion 211 of the actuator 3, with the insertion plate 311 thereof being inserted into the slot 2111 and the click projections 3110 thereof frictionally engaging with the slot 2111. The pair of elastic beams 32 is positioned between the pair of periphery walls 212. The spring 4 is assembled to the actuator 2 by encircling around the post 23. Secondly, The actuator 2 together with the moveable contact 3 and the spring 4 is received in the cavity 15 of the insulative housing 1, with the button 22 extending outside the front wall 12 through the through hole 121.

Thirdly, the pair of fixed contacts 6 are assembled to the base 5. The body portions 61 of the fixed contacts 6 are respectively partially retained in corresponding retaining channels 521, with engaging portions 611 thereof being exposed on the inner face 51, the connection portions 62 thereof inserted into the corresponding insertion channels 54, and the soldering portions 64 thereof extending outwardly through the insertion channels 54. Finally, the base 5 together with the fixed contacts 6 is attached to an opening of the insulative housing 1, with the inner face 51 exposed in the cavity 15. The side faces 53 of the base 5 are conglutinated to the walls 11, 12, 13 of the insulative housing 1 by glue or epoxy. Glues through any gaps (not shown) between the side faces 53 of the base 5 and side edges of the walls 11, 12, 13 of the insulative housing 1 is then confined in the slots 523, 5221 of the base 5 and therefore would not creep into other portions of the assembled sealed pushbutton switch 100.

Figure 4:
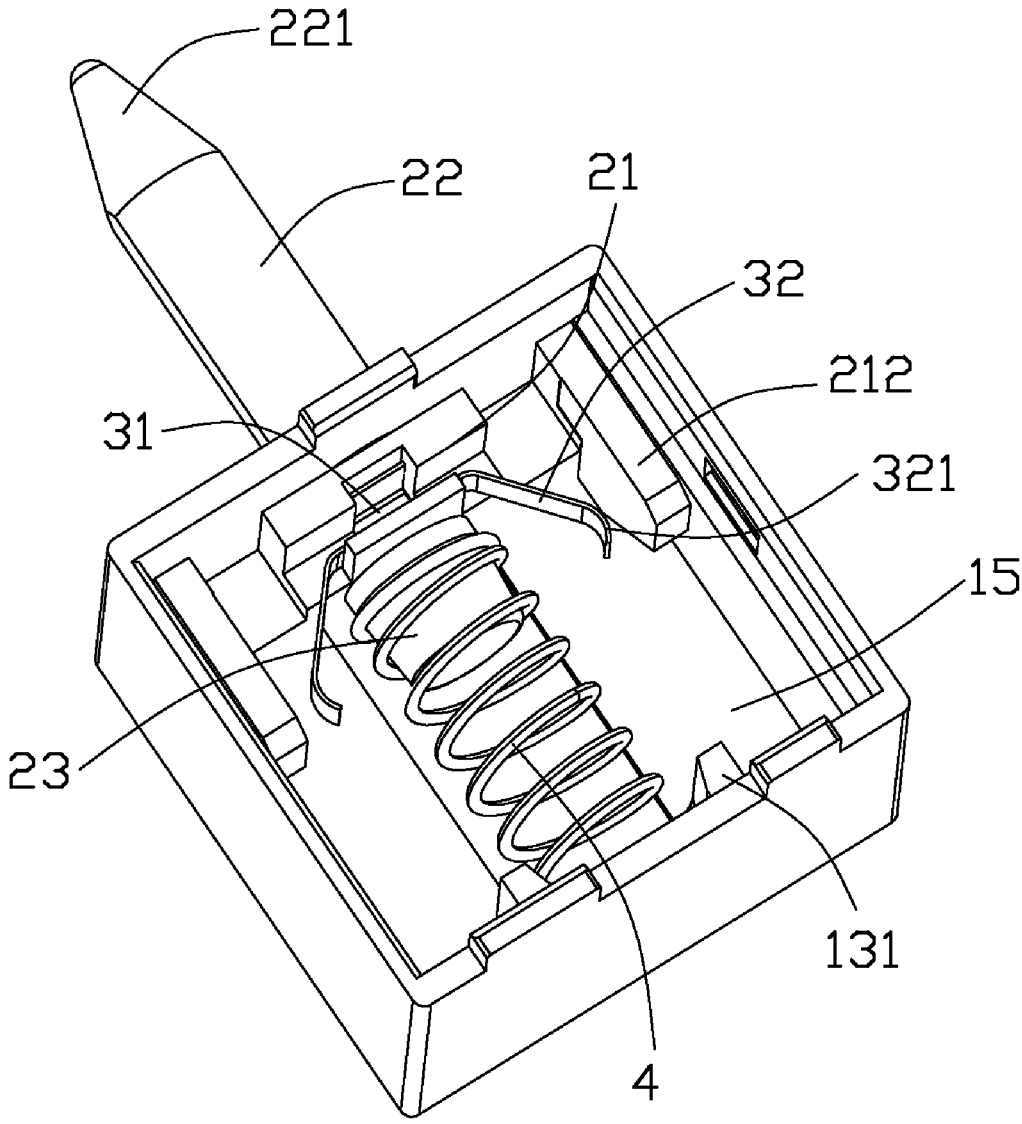
FIG. 4 is an assembled perspective view of the sealed pushbutton switch as shown in FIG. 1, with the base and the fixed contacts being removed.

Referring to FIG. 4, in a normal position, the spring 4 is located between the actuator 2 and the bottom wall 13 of the insulative housing 1, with a lower portion thereof fixed between by the C-shape protrusion 131. The pair of elastic beams 32 of the moveable contact 3 are positioned between the fixed contacts 6, with the contact portions 321 thereof respectively contacting with the corresponding engaging portions 611. An electrical connection between the fixed contacts 6 is established, via an engagement between the contact portions 321 and the engaging portions 611 of the fixed contacts 6. The sealed pushbutton switch 100 is in the closed position.

In operation, when the button 22 of the actuator 2 is downwardly pushed by exerting an external force, the moveable contact 3 is driven to move downwardly together with the actuator 2 to thereby move the contact portions 321 away from the engaging portions 611 and into the indentations 63. The sealed pushbutton switch 100 is caused to be in an electrically opened position, when the electrical connection between the engaging portions 611 of the fixed contacts 6 is broken. At the same time, the spring 4 is compressed. When the external force is removed, the pushbutton switch 100 restores itself to a normally closed position, due to an elastic force provided by the compressed spring 4.

However, the disclosure is illustrative only, changes may be made in detail, especially in matter of shape, size, and arrangement of parts within the principles of the invention.

What is claimed is:

1. A sealed pushbutton switch, comprising:

an insulative housing defining a cavity and a first opening on a first side;

a base attached unto the first side and covering the first opening, the base having a first slot formed along an edge of an inner face thereof;

an actuator moveably retained in the cavity of the insulative housing;

a plurality of fixed contacts assembled to the base;

a spring compressed between said actuator and the insulative housing; and a moveable contact provided with a plurality of contact portions and being moveable with the actuator from a first position where the contact portions are in contact with corresponding fixed contacts to a second position where the contact portions disengage from the fixed contacts;

wherein the base defines a groove on the inner face for engaging with the actuator, a second slot is formed along an edge of the groove of said base, the second slot have a connection with the first slot so as to retain glue therein when said base and said housing are fastened together by said glue.

2. The sealed pushbutton switch as claimed in claim 1, wherein said base comprises the inner face exposed in the cavity and an outer face opposite to the inner face.

3. The sealed pushbutton switch as claimed in claim 2, wherein said base defines therein a plurality of retaining channels, and wherein each fixed contact has a body portion retained in corresponding retaining channel and an engaging portion exposed in the cavity for engaging with corresponding contact portion of said moveable contact.

4. The sealed pushbutton switch as claimed in claim 3, wherein said fixed contact has an indentation defined beside the engaging portion.

5. The sealed pushbutton switch as claimed in claim 4, wherein each fixed contact comprises a pair of soldering portions extending outside the base and a pair of connection portions connecting corresponding soldering portions to the body portion, and said base defines a pair of insertion channels communicating with corresponding retaining channels for insertion of the connection portions.

6. The sealed pushbutton switch as claimed in claim 3, wherein said moveable contact comprises a retention portion and a pair of outspreading elastic beams, the contact portions being formed on corresponding elastic beams.

7. The sealed pushbutton switch as claimed in claim 6, wherein said actuator comprises a body portion, a button extending upwardly from the body portion, and a post extending downwardly from the body portion with a first end of the spring encircling therearound.

8. The sealed pushbutton switch as claimed in claim 7, wherein said button of the actuator is formed with a column portion and a conical guiding portion.

9. The sealed pushbutton switch as claimed in claim 7, wherein said body portion of the actuator is formed with a primary wall, a pair of periphery walls perpendicular to the primary wall, a nose portion extending rearwardly from an upper portion of the primary wall for upholding the button, and a tongue portion positioned below the nose portion.

10. The sealed pushbutton switch as claimed in claim 9, wherein said retention portion of the moveable contact is mounted between the nose portion and the tongue portion of the actuator.

11. The sealed pushbutton switch as claimed in claim 1, wherein said base comprises four side faces defined near the first slot.

12. The sealed pushbutton switch as claimed in claim 11, wherein said housing comprise a back wall, a front wall defining a through hole for partially extension of the actuator, and a pair of opposite side walls defining a pair of recesses for engaging with a pair of tubers formed on the base.

13. The sealed pushbutton switch as claimed in claim 12, wherein said back wall is symmetrically formed thereon a C-shape protrusion, between which a second end of the spring is confined.

14. A sealed pushbutton switch comprising:

an insulative rectangular housing defining a cavity and a first opening on a first side and a circular through hole in a second side perpendicular to the first side;

a base attached unto the first side and covering the first opening;

a plurality of fixed contacts secured to the base;

an actuator moveably retained in the cavity of the housing and having a button extending out from the circular through hole; and a moveable contact associated with the actuator and moveable between a first position where the moveable contact is engaged with the fixed contact, and a second position where the moveable contact is disengaged from the fixed contact; wherein a first slot is formed along an edge of a inner face of said base and a second slot is formed on a position of the inner face except the edge, the second slot have a connection with the first slot so as to retain glue therein when said base and said housing are fastened together by said glue.

15. The sealed pushbutton switch as claimed in claim 14, wherein the base defines a groove for engaging with a nose potion of the actuator, the second slot is formed along an edge of the groove of said base.

16. A sealed pushbutton switch comprising:

an insulative housing defining a cavity and a first opening on a first side and a through hole in a second side different from the first side;

a base attached unto the first side and covering the first opening;

a plurality of fixed contacts secured to the base;

an actuator moveably retained in the cavity of the housing and having a button extending out of the through hole; and a moveable contact associated with the actuator and moveable between a first position where the moveable contact is engaged with the fixed contact, and a second position where the moveable contact is disengaged from the fixed contact; wherein on one of said base and said housing adjacent an interface therebewteen, a first slot is formed along an edge of an inner face thereof, and a second slot is formed on an inner position of said inner face spaced from the edge with a channel therebetween to guide excess glue, which is originally expected to be retained in the first slot when said base and said housing are fastened together by said glue, from the first slot into the second slot without splitting improperly.

17. The sealed pushbutton switch as claimed in claim 16, wherein the base defines a groove for engaging with a nose potion of the actuator, the second slot is formed along an edge of the groove of said base.

* * * * *